US005918754A

United States Patent [19]

Lyons et al.

[11] Patent Number: 5,918,754

[45] Date of Patent: Jul. 6, 1999

[54] BLOW-MOLDED PLASTIC CONTAINER WITH PERMANENTLY ATTACHED SEPARATE HANDLE

[75] Inventors: Crawford Lyons, Spring Grove, Pa.; Frank E. Semersky, Toledo, Ohio

[73] Assignee: Graham Packaging Corporation, York, Pa.

[21] Appl. No.: 08/694,348

[22] Filed: Aug. 7, 1996

[51] Int. Cl.[6] ..... B65D 25/28

[52] U.S. Cl. ..... 215/398; 215/396; 220/770

[58] Field of Search ..... 215/396, 398; 220/761, 770, 771, 675

[56] References Cited

U.S. PATENT DOCUMENTS

| | | | |
|---|---|---|---|
| D. 194,285 | 12/1962 | Miller . | |
| D. 318,229 | 7/1991 | Umetsu . | |
| 3,661,661 | 5/1972 | Berleyoung . | |
| 3,819,437 | 6/1974 | Paine . | |
| 4,169,751 | 10/1979 | Yen . | |
| 4,211,923 | 7/1980 | Fukuyama et al. . | |
| 4,230,757 | 10/1980 | Toner . | |
| 4,257,525 | 3/1981 | Thompson . | |
| 4,273,246 | 6/1981 | Thompson . | |
| 4,280,859 | 7/1981 | Thompson . | |
| 4,293,359 | 10/1981 | Jakobsen . | |
| 4,326,902 | 4/1982 | Peddie . | |
| 4,368,826 | 1/1983 | Thompson . | |
| 4,372,454 | 2/1983 | Thompson . | |
| 4,411,720 | 10/1983 | Sager . | |
| 4,564,932 | 1/1986 | Lange . | |
| 4,618,516 | 10/1986 | Sager . | |
| 4,629,598 | 12/1986 | Thompson . | |
| 4,726,481 | 2/1988 | Hagan . | |
| 4,746,025 | 5/1988 | Krautkramer et al. . | |
| 4,767,492 | 8/1988 | Fukusima et al. . | |
| 4,832,216 | 5/1989 | Reyes . | |
| 4,834,819 | 5/1989 | Todo et al. . | |
| 4,863,046 | 9/1989 | Collette et al. | 220/675 |
| 4,909,978 | 3/1990 | Hasegawa . | |
| 4,931,114 | 6/1990 | Sliva . | |
| 4,952,133 | 8/1990 | Hasegawa . | |
| 4,954,191 | 9/1990 | Delespaul et al. . | |
| 4,964,522 | 10/1990 | Umetsu et al. . | |
| 5,040,357 | 8/1991 | Ingemann . | |
| 5,085,719 | 2/1992 | Eck . | |
| 5,089,208 | 2/1992 | Nakamura et al. | 215/398 |
| 5,244,520 | 9/1993 | Gordon et al. . | |
| 5,256,225 | 10/1993 | Dwinell . | |
| 5,269,917 | 12/1993 | Stankowski . | |
| 5,275,767 | 1/1994 | Micciche . | |
| 5,304,265 | 4/1994 | Keeler . | |
| 5,316,603 | 5/1994 | Akazawa et al. . | |
| 5,338,503 | 8/1994 | Yanagisawa et al. . | |
| 5,392,937 | 2/1995 | Prevot et al. . | |
| 5,401,342 | 3/1995 | Vincent et al. . | |
| 5,403,415 | 4/1995 | Schembri . | |
| 5,411,618 | 5/1995 | Jocewicz, Jr. . | |
| 5,435,863 | 7/1995 | Frantz . | |
| 5,469,612 | 11/1995 | Collette et al. . | |
| 5,535,901 | 7/1996 | Ishii et al. | 215/396 |
| 5,637,167 | 6/1997 | Krishnakumar et al. | 215/396 |

OTHER PUBLICATIONS

Magazine Article—*Better Bonds—Plastics Welding Gets Smarter, Faster, Stronger*—Plastics Technology, p. 18.

*Primary Examiner*—Stephen J. Castellano
*Attorney, Agent, or Firm*—Howson and Howson

[57] ABSTRACT

A blow-molded plastic container having a separately formed and permanently attached handle. The container has a blow-molded body portion with an inwardly set recess. An elongate plastic handle is attached to the sidewall of the container such that it spans across the recess in spaced relation. The handle has a grip portion and opposite ends which are secured to the body portion by welding techniques. The recess has a vacuum flex panel to accommodate changes resulting from hot-fill processing.

35 Claims, 3 Drawing Sheets

FIG. 1
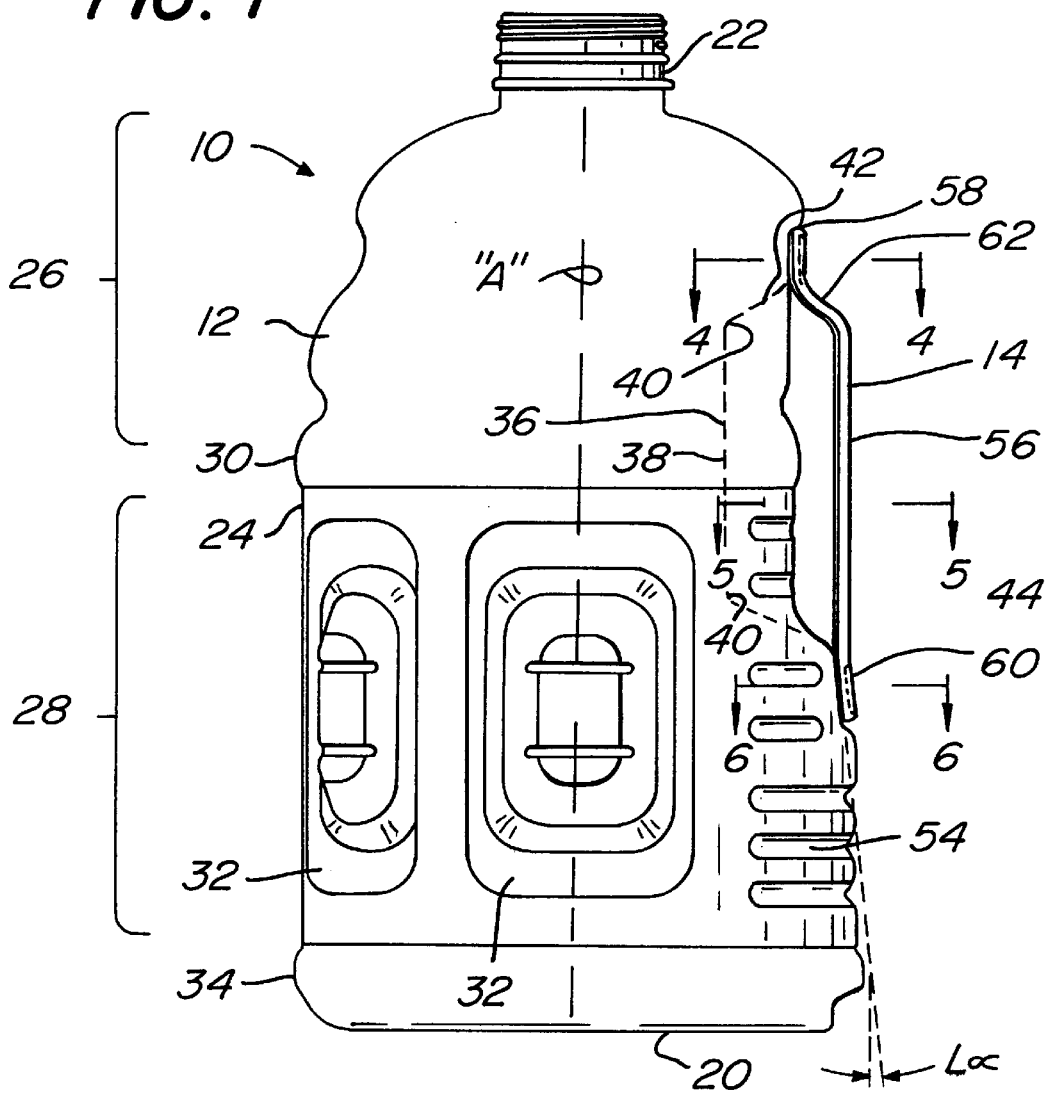
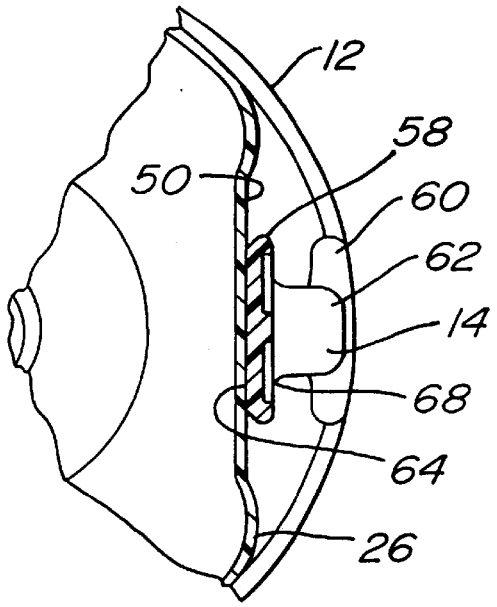
FIG. 4

FIG. 2
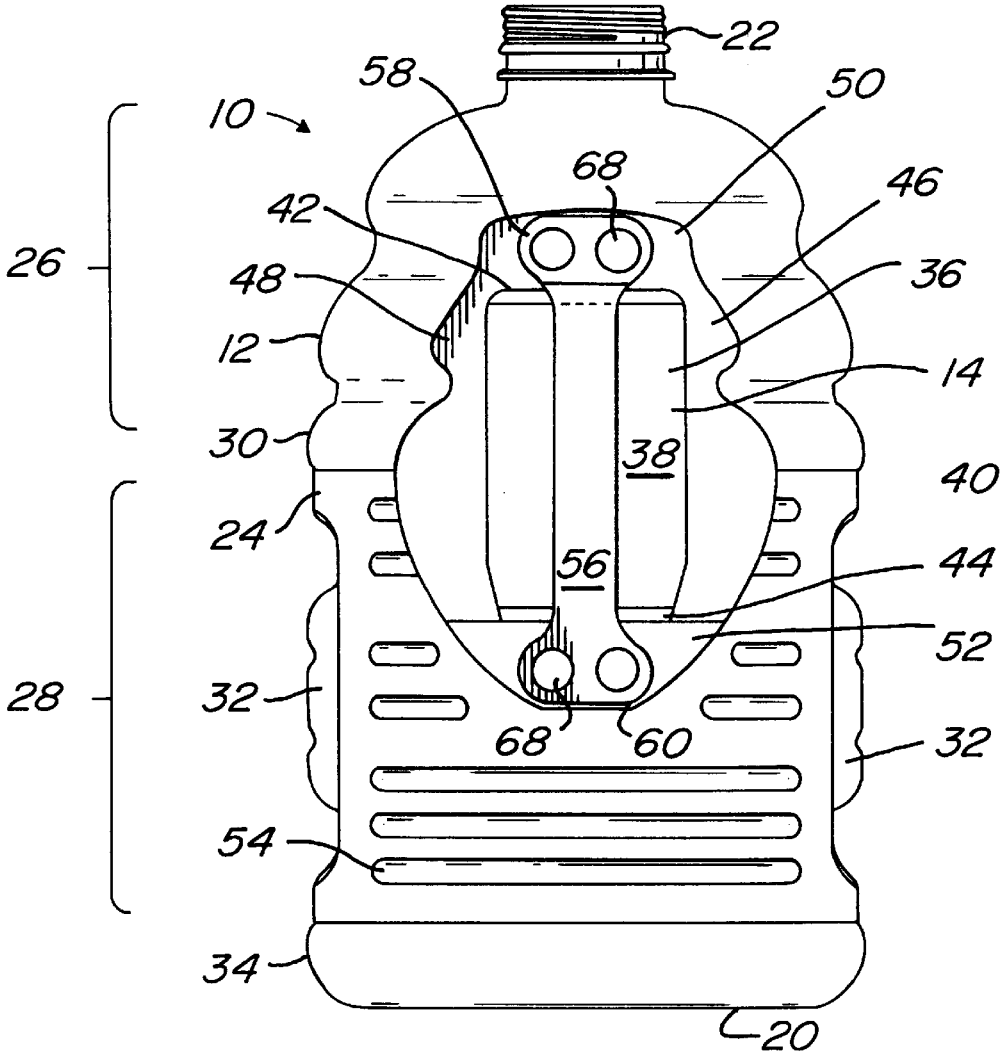
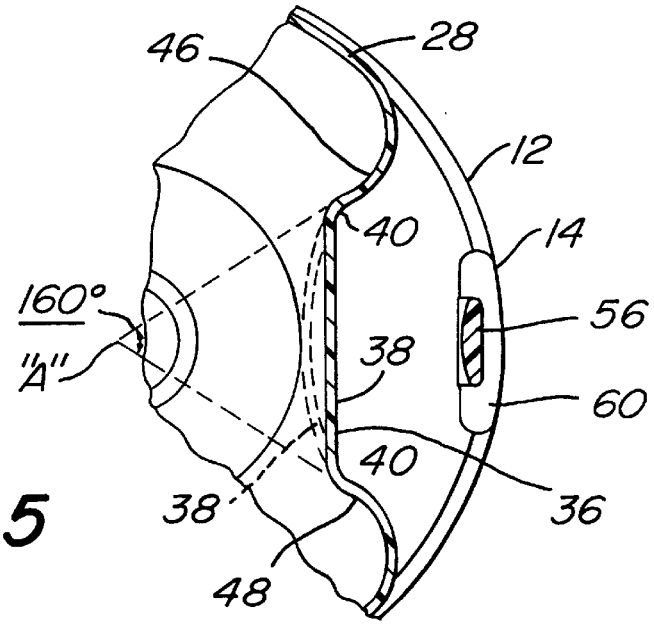
FIG. 5

FIG. 3
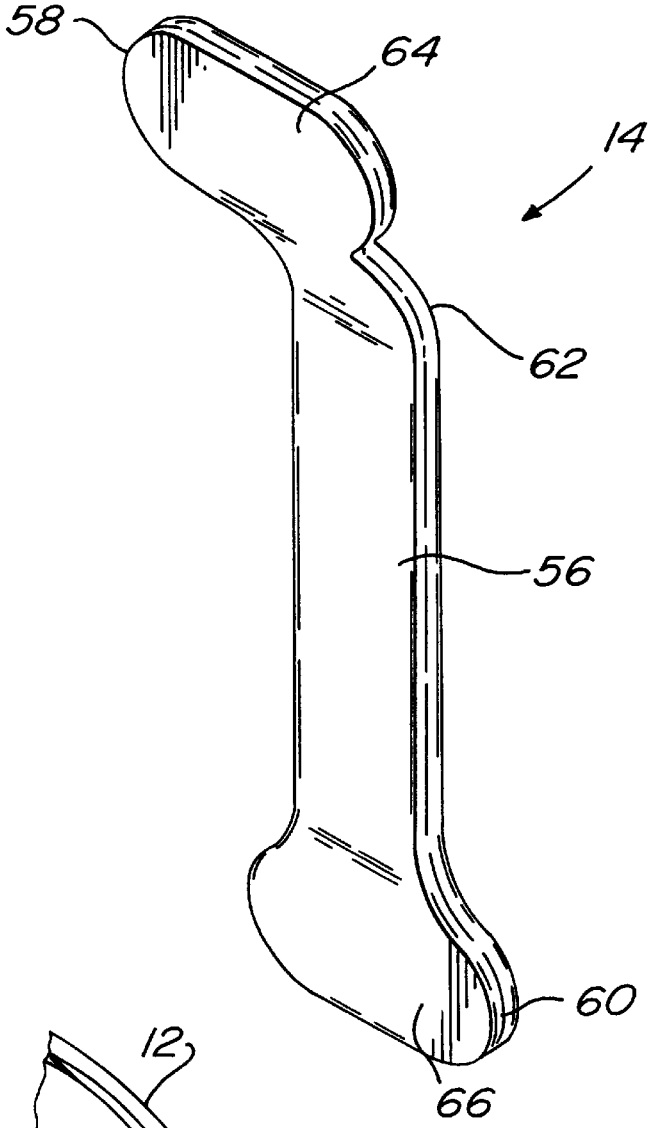
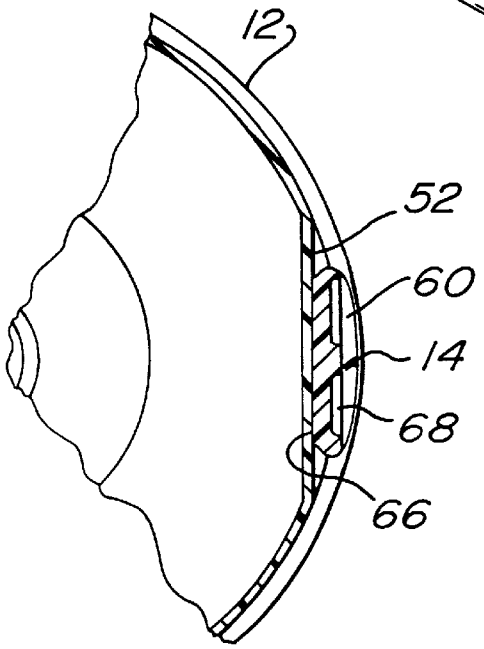
FIG. 6

BLOW-MOLDED PLASTIC CONTAINER WITH PERMANENTLY ATTACHED SEPARATE HANDLE

FIELD OF THE INVENTION

The present invention relates to plastic containers having separate plastic handles permanently attached thereto. More particularly, the present invention relates to a blow-molded container which has a separately attached handle and which also may include means for accommodating volumetric changes in the contents of the container after it has been hot-filled and cooled.

BACKGROUND OF THE INVENTION

The use of blow-molded plastic containers has become commonplace in packaging beverages and liquid, gel, granular, or other products. In the packaging of beverages, especially juice, blow-molded plastic PET containers are particularly useful in the so-called "hot-fill" process, i.e. filling the containers with beverages at an elevated temperature, sealing the containers, then allowing the beverage to cool.

Blow-molded plastic containers use vacuum flex panels to provide sufficient flexure to compensate for changes in pressure resulting from volume changes caused by temperature changes of the container contents, while maintaining structural integrity and aesthetic appearance. For instance, U.S. Pat. No. 5,392,937 issued to Prevot et al., and owned by the assignee of the present application, discloses the use of vacuum flex panels in a hot-fillable, blow-molded container.

Some containers require the use of handles to afford the user an easier ability to lift the container and/or pour its contents, preferably with one hand. Smaller sized containers, such as 64 ounces and less, generally do not need handles because a consumer can grasp the sides of the container to manipulate the container with one hand. However, larger containers, such as gallon containers, may require some form of handle in order for a user to control the container while lifting or pouring its contents with one hand.

BRIEF DESCRIPTION OF PRIOR ART CONTAINERS AND HANDLE ATTACHMENT TECHNIQUES

A. Integral Handle Containers

Containers have been blow-molded with integral handles, for example, one gallon plastic containers used in packaging milk. Such containers are formed with a hollow handle extending from the neck of the container to the sidewall of the container, as illustrated in U.S. Design Pat. No. D.194, 285 issued to Miller.

B. Neck Secured Handle Containers

Some containers have rigid handles extending from the neck of the container. U.S. Pat. No. 5,469,612 issued to Collette et al, FIGS. 14–18, and U.S. Pat. Nos. 4,273,246 and 4,368,826 issued to Thompson disclose separately formed handles with one end of the handle snapping into engagement with the neck of the container. U.S. Pat. Nos. 4,372,454, 4,629,598 and 4,280,859 issued to Thompson disclose preforms with one end of a handle formed integral with the neck of the preform.

C. Bail Handle Containers

Other containers have handles which include a collar surrounding the neck and an open loop molded integral with the collar. For instance, see U.S. Pat. No. 4,832,216.

D. Blown-Around Handle Containers

Yet other containers secure separately formed plastic handles to the sidewall by blow-molding the container body around a portion of the handle to hold the handle in place. For instance, see U.S. Pat. Nos. 4,964,522 and D.318,229 issued to Umetsu et al.; U.S. Pat. Nos. 4,909,978 and 4,952,133 issued to Hasegawa et al.; and U.S. Pat. No. 5,338,503 issued to Yanagisewa et al.

E. Snap Fit Handle Containers

Separately formed handles also may snap fit into concavities formed in the sidewalls of fully blow-molded container bodies. For instance, see the above referenced '612 Collette et al. patent and U.S. Pat. No. 4,257,525 issued to Thompson.

F. Welding Techniques

Ultrasonic vibration is one of many techniques used to weld confronting surfaces of containers and attachments. The technique employs the use of high pitched sound waves to cause juxtaposed objects to vibrate. In turn, when this vibration attains a certain intensity for a sufficient duration, the objects, if plastic, melt from the heat generated by the vibration and flow together. When released from ultrasonic vibration, and allowed to cool for a sufficient time, the molten plastic hardens to form a weld.

The above referenced Thompson '246, '859, '826 and '454 patents disclose ultrasonic welding of one lower free end of a handle to the sidewall of a container. U.S. Pat. No. 4,293,359 issued to Jakobsen discloses welding a base support cup to the base of a plastic blow-molded container, using radially-extending ribs to facilitate welding. U.S. Pat. No. 5,275,767 issued to Micciche discloses connecting a base to a sidewall of a container. U.S. Pat. Nos. 5,256,225 issued to Dwinell; 5,244,520 issued to Gordon et al.; 4,726,481 issued to Hagan; 5,304,265 issued to Keeler; and 4,746,025 issued to Krautkramer et al. disclose welding nozzles, spouts and neck inserts to containers. U.S. Pat. Nos. 5,040,357 issued to Ingemann; 4,954,191 issued to Delespaul et al.; and 5,316,603 issued to Akazawa disclose welding lids, covers and seals to containers.

In the course of ultrasonically welding confronting surfaces, so-called "energy directors", or "energy absorbers" enhance the process to yield stronger welds. Such energy directors are small raised patterns of plastic which are located on either or both confronting surfaces to concentrate the ultrasonic energy. This concentration of energy, coupled with the raised plastic, allows the plastic to melt faster and more controllably. The above referenced '359 Jakobsen patent discloses the use of a circular-shaped energy director, and a star-shaped energy director having radial spokes, to weld a base support cup to the base of a blow-molded container. U.S. Pat. Nos. 4,326,902 issued to Peddie; 3,661,661 issued to Berleyoung; 3,819,437 issued to Paine; 4,169,751 issued to Yen; 4,211,923 issued to Fukuyama et al.; 4,230,757 issued to Toner; 4,411,720 and 4,618,516 issued to Sagar; 4,564,932 issued to Lange; 4,767,492 issued to Fukusima et al.; 4,834,819 issued to Todo et al.; 4,931,114 issued to Sliva; 5,085,719 issued to Eck; 5,269,917 issued to Stankowski; 5,401,342 issued to Vincent et al.; 5,403,415 issued to Schembri; 5,411,618 issued to Jocewicz, Jr.; and 5,435,863 issued to Frantz disclose various shaped energy directors used to weld a variety of plastic surfaces together.

NEED FOR THE INVENTION

Although various ones of the referenced containers having handles, or vacuum flex panels, may function satisfactorily for their intended purposes, a need exists for a blow-molded plastic container having a separately formed, permanently attached handle that enables the container to be lifted and poured more readily, and that can better accommodate volumetric changes resulting from hot-fill processing. Additionally, the handle-to-container connection should withstand the forces exerted under normal consumer use for package sizes of at least one gallon. Finally, the manufacture of the container bodies and separate handles, and the welding thereof, should be cost effective.

OBJECTS OF THE INVENTION

With the foregoing in mind, a primary object of the present invention is to provide a blow-molded container having a separately manufactured and permanently secured handle.

Another object of the present invention is to provide a handled container capable of accommodating changes in the container contents resulting from hot-fill processing.

A further object is to provide a container having a strong weld between the handle and the sidewall.

Still further objects are to provide a container which is cost effective to manufacture, structurally sound, aesthetically appealing, and completely recyclable using current recycling techniques and processes.

Yet another object is to provide a container wherein the attached handle is generally confined within the profile of the container.

SUMMARY OF THE INVENTION

The present invention provides a blow-molded plastic container having a handle affording pouring of its contents which may be hot-filled. The container comprises a blow-molded body portion having an inwardly set recess. The handle is situated across the recess and may be of any shape. In its preferred embodiment, the handle is elongate and separately-formed in a strap-like shape. This handle has a grip portion extending between opposite ends which are permanently attached to the body portion. The grip portion of the handle spans across the recess to enable the recess to flex and thereby accommodate container content volumetric changes resulting from hot-filling. The recess also provides space in which a user can place his or her fingers for gripping the handle.

The handle can be welded by ultrasonic vibration, or other known welding techniques, such as infrared radiation, hot-plate, mechanical vibration, and solvent welding. Energy directors may be molded into the handle to facilitate welding.

BRIEF DESCRIPTION OF THE DRAWINGS

The foregoing and other objects, features and advantages of the present invention should become apparent from the following description, when taken in conjunction with the accompanying drawings, in which:

FIG. 1 is an elevational view of a container embodying the present invention in its preferred configuration;

FIG. 2 is an elevational view of the container illustrated in FIG. 1 rotated 90° clockwise about a central vertical axis through the container;

FIG. 3 is a perspective view of a separately formed handle according to the preferred configuration of the present invention;

FIG. 4 is a horizontal cross-sectional view of the container body and upper end of the handle taken along line 4—4 of FIG. 1;

FIG. 5 is a horizontal cross-sectional view of the container body and grip portion of the handle taken along line 5—5 of FIG. 1; and FIG. 6 is a horizontal cross-sectional view of the container body and lower end of the handle taken along line 6—6 of FIG. 1;

DETAILED DESCRIPTION OF THE PREFERRED EMBODIMENT

As illustrated in FIG. 1, the present invention provides a container 10 designed to enhance a user's ability to lift and pour from the container. Though container 10 can be manufactured in various sizes, the present invention is especially useful for larger size containers, such as a gallon, which usually require two hands to manipulate effectively. The container 10 can be used to package a variety of products, but is particularly useful in packaging beverages filled hot, such as juice.

The container 10 comprises a body portion 12 and a handle 14. Both are formed separate from one another, then secured together at a later time using a separate process and station. The body portion 12 can be produced by conventional blow-molding operations, which may include additional means such as for heat-setting. The handle 14 can be produced by conventional injection molding techniques. Both the body portion 12, and the handle 14, are preferably made from the same plastic, such as PET, so that both may be recyclable without requiring separation. Thus, the required manufacturing processes allow efficient and inexpensive mass production of environmentally preferred containers 10.

Before turning to the unique aspects of the present invention, a discussion follows of the similarities of the container 10 with known blow-molded containers.

As shown in FIG. 1, the body portion 12 has a base 20 for supporting the container on a horizontal surface; a finish 22 providing an opening to fill, empty, and seal the container 10; and a sidewall 24 extending between, and integrally connecting the base 20 to the finish 22. The sidewall 24 comprises an upper, or dome, portion 26 and lower portion 28. The dome 26 locates the finish 22 on the top of the container 10. The lower portion 28 extends from the base 20 and is separated from the dome 26 by a peripheral rib 30.

The container 10, particularly the lower portion 28 of the sidewall 24, can be manufactured so that the container is suited for use in hot-fill processing. However, the container 10 is also useful in non-hot-fill processes. If the container 10 is used in hot-fill processes, either the lower portion 28, or the dome portion, can have any number and type of vacuum flex panels for accommodating the volumetric changes of the container contents after the container is hot-filled, sealed and cooled.

FIG. 1 illustrates a container which has four vacuum flex panels 32 located entirely in the lower portion 28 of the container (two vacuum flex panels 32 are shown in FIG. 1, and two are located on the opposite side of the container, which is a mirror image of FIG. 1). The lower portion 28 also provides label mounting areas. To this end, peripheral rib 30 acts as an upper label bumper and a lower peripheral rib 34 acts as a lower label bumper.

The container has three unique aspects: A) the shape, location and functionality of a recess 36 on the body portion 12, B) the shape and location of the separately attached handle 14, and C) the means for attaching the separate handle to the container body.

THE RECESS

The container body portion 12 is blow molded with an inwardly set handle recess 36. As illustrated, the container body has a substantially circular cross-section; however, the container body can have other cross-sectional shapes such as polygonal or rectangular. The recess has two major purposes. The first purpose is to provide space for the user's fingers between the body portion 12 and an attached handle 14 when grasping the handle 14, while maintaining the handle's outer dimension generally within, or close alongside, the body. The second purpose is to provide a panel which can function as a vacuum flex panel, as will be discussed.

The shape of the recess 36 may vary, but a preferred shape is illustrated in FIG. 2. The inward-most part of the recess 36 forms a panel 38. The panel 38 is intended to be manufactured substantially planar and vertically oriented, but may be on an angle with respect to the bottle center, especially if the recess generally follows a bell contour. Along the entire periphery of the panel 38 is a hinge 40. An upper transitional wall 42, a lower transitional wall 44, a right side transitional wall 46, and a left side transitional wall 48 extend from the hinge 40 and merge with the body portion 12. As best shown in FIG. 5, the right and left side transitional walls, 46 and 48, extend at an included angle of about 60° relative to a longitudinal vertical axis "A" of the container. The longitudinal vertical axis "A" is defined as extending centrally from the base 20 vertically to the finish 22. Thus, the recess 36 consists of the panel 38, the hinge 40, and transitional walls 42, 44, 46 and 48.

The body portion 12 is also formed with an upper handle mounting surface 50 and a lower handle mounting surface 52. The upper handle mounting surface 50 is planar and substantially vertical, but could be at an angle with respect to the vertical axis. The upper handle mounting surface 50 is located directly above the recess 36 and merges with the upper transitional wall 42. The lower handle mounting surface 52 is also substantially planar, but preferably, it extends at an angle "$\alpha$" relative to the vertical plane. The angle "$\alpha$" is best shown in FIG. 1 and is preferably 6° to aid in handle attachment, as will be discussed. The lower handle mounting surface 52 is located directly below the recess 36 and merges with the lower transitional wall 44. Thus, the inwardly set recess 36 and the upper and lower handle mounting surfaces, 50 and 52, transition smoothly into the adjacent, substantially circular, cross-sectioned body portion 12.

The location of the recess 36 on the body portion 12 may vary, but a preferred position is on the sidewall 24 extending on parts of both the dome portion 26 and the lower portion 28. This location provides a balance, or pivot, point to afford ease of pouring from the container. The upper transitional wall 42 of the recess 36 and the upper handle mounting surface 50 are spaced from the finish 22 and are positioned in the dome portion 26. The lower transitional wall 44 of the recess 36 and the lower handle mounting surface 52 are spaced from the base 20 and are positioned on the lower portion 28 of the sidewall 24. The panel 38 and the right and left side transitional walls, 46 and 48, interrupt the peripheral rib 30 and extend on parts of both the dome portion 26 and the lower portion 28 of the sidewall 24.

The sidewall 24 is sufficiently rigid adjacent the handle 14 to prevent the sidewall from buckling upon lifting of, and pouring from, the container 10. To this end, a series of horizontally oriented reinforcement ribs 54 are located in the lower portion 28 between the lower handle mounting surface 52 and the lower peripheral rib, or label bumper, 34. Shorter ribs extend in horizontally spaced relation laterally on opposite sides of the recess. The ribs also counter deformations caused by vacuum as well as squeezing pressures exerted by users. Rib arrangements, other than horizontal, may also be used in certain applications.

Until the present invention, it has been difficult to produce a PET blow-molded container having a handle, especially containers intended for use in hot-fill processing of beverages. This is because the commonly preferred asymmetric distribution of vacuum panels, and/or insufficient vacuum accommodation, can lead to gross deformations, such as ovalization, or lesser deformations such as localized dents and buckling.

To address this problem, the panel 38 of the present invention acts as a vacuum flex panel to accommodate content volumetric changes within the hot-filled container 10 upon cooling. As best shown in FIG. 5, the panel 38 is designed to bow inwardly, as shown in dashed lines, to accommodate the vacuum generated internally within the container 10. The hinge 40 allows panel 38 to bow inwardly, while preventing the transitional walls 42, 44, 46 and 48, as well as the surrounding body portion 12, from grossly distorting. Thus, the combined action of the panel 38 and the other vacuum flex panels 32 maintain the substantially uniform and circular cross section of the container 10 which aids in providing an aesthetic overall container appearance and minimizes problems, in areas such as packing, that may result from ovalized containers.

Acting in concert with the handle, the recess furthermore allows the placement of the handle largely within the perimeter of the bottle, which is important for considerations of bottle filling, merchandising shelf efficiency, and consumer shelf efficiency. Also, when placed near the balance/pivot point, the handle and recess, working with the bottle's center of mass, eases the user's ability to pour from the container.

THE HANDLE

As shown in FIG. 3, the handle 14 is a rigid strap-type handle formed separately from the body portion 12. When attached to the body portion 12, the handle 14 is intended to span across the recess 36 in spaced relation therewith.

The shape of the handle 14 can vary, but preferably it has a grip portion 56 which can be grasped comfortably by the user. When affixed to the body portion 12, the grip portion 56 extends vertically alongside the recess, or alternatively could extend at an angle across a recess. Opposite ends of the handle 14 have an upper ear attachment tab 58 and a lower ear attachment tab 60. The upper tab 58 merges with the grip portion 56 via transitional handle section 62. The upper tab 58 has a container engaging surface 64 which is secured to the upper handle mounting surface 50 of the body portion 12. When affixed to the container, the upper tab 58 is oriented substantially vertical. The lower tab 60 extends from the grip portion 56 at an angle of about 6° which corresponds to the angle "$\alpha$" of the lower handle mounting surface 52. The lower tab 60 has a container engaging surface 66 which is secured to the lower handle engaging surface 52 of the body portion 12.

Alternative handle shapes include an inverted "J" configuration (not shown). Such a handle has a top portion which is reversely turned to engage the sidewall of the container on the upper transitional wall 42. The lower portion is of the same configuration as illustrated and is similarly connected.

The preferred means for attaching the handle 14 to the body portion 12 is to weld together the engaging surfaces: 64 to 50, and 66 to 52, using any one of a number of known techniques as will be discussed.

The present assignee's co-pending U.S. patent application, Ser. No. 08/414,646, the disclosure of which is incorporated herein by reference, discloses methods utilizing ultrasonic techniques to attach a separately formed plastic handle having a base with a pair of parallel, integrally formed protrusions to a blow-molded plastic container. Preferably, the interior of the container adjacent the handle attachment location is rigidly supported to aid in the formation of a strong bond between the container and the handle. To this end, an anvil can be manipulated within the container to engage the interior surface of the container adjacent the handle attachment location, or the container can be located within a dummy mold and be pressurized to rigidify this same area.

As previously stated, the lower handle mounting surface 52 of the sidewall 24 and the lower tab 60 of the handle 14 are at an angle "α" relative to the vertical axis "A". This relationship allows for ready manipulation of a single anvil to first support the connection between the container and the upper tab of the handle, and then the connection between the container and the lower tab of the handle, or vice versa.

The upper and lower tabs, 58 and 60, of the handle 14 may incorporate energy directors (not shown) as disclosed in U.S. Pat. No. 4,293,259, issued to Jakobsen on Oct. 6, 1981, the disclosure of which is incorporated herein by reference. The energy directors, as disclosed in Jakobsen and the earlier mentioned U.S. Patent application Ser. No. 08/414,646, aid in the formation of a strong bond between the container and the handle. In addition, when ultrasonic energy horns are utilized, the sides of the upper and lower tabs, 58 and 60, which confront the ultrasonic horns (not shown), have horn alignment depressions 68 to ensure proper alignment between the handle 14 and the ultrasonic horns.

Although the above referenced method of attachment involves the use of ultrasonic techniques, other known means for attaching the handle to the container can be used. An article entitled *Better Bonds—Plastics Welding Gets Smarter, Faster, Stronger,* published in *Plastic Technology* magazine in a January 1996 issue, the disclosure of which is incorporated herein by reference, discloses various known welding techniques such as infrared, laser and spin welding which can be used to weld the handle to the container. In addition, hot-plate, mechanical vibrations, and solvent welding techniques can also be used.

The location of the handle attachment 14 on the body portion 12 is also an important aspect of the present invention. As illustrated, the grip portion 56 is spaced from and spans across the entire recess 36. Thus, the handle 14 does not contact or extend into the recess 36. This configuration allows the fingers of a user to fit between the recess 36 and the handle 14, permits the panel 38 of the recess 36 to flex inwardly to accommodate volumetric changes of a container used in hot-fill processing, and enables the handle to conform closely to the exterior contour of the container.

As best illustrated in FIG. 1, the permanently secured handle 14 conforms closely with the vertical contour of the container 10. Since the handle does not extend peripherally outside of the footprint of the container, the container can be packed efficiently and shipped in a minimum of space. In addition, a rigid container structure is formed because the handle 14 bridges across the recess 36, and thus, supports the sidewall, particularly at the recess, from buckling when the container is manipulated by a user. This is particularly valuable in storage situations wherein containers are stressed by the downward forces exerted by the containers stacked one on top of another.

For application where space is less of a premium, the handle grip portion can be spaced outwardly from the container sidewall.

In other embodiments, the handle may have its upper end attached to the dome and its lower end attached at a lower location. The handle can also be made of flexible plastic, and may be stretched across the recess to provide a measure of stiffness.

The described structure affords ready lifting and pouring, even of larger size containers. The container is efficiently and inexpensively manufactured because the body portions and handles are formed separately. This allows for the attachment process to take place separately from container formation, thereby avoiding undesirable complications and increased expenses in the container forming equipment. The body portion and handle can be firmly and readily secured together. The container has specified areas which can flex to provide an aesthetic container appearance even under hot-fill processing conditions; yet the container, specifically at the handle, is rigid. Also, the invention affords space efficient, cost effective storage of containers.

While a preferred container has been described in detail, various modifications, alterations, and changes may be made without departing from the spirit and scope of the present invention as defined in the appended claims.

We claim:

1. A blow-molded, plastic container having a handle affording pouring of its contents, comprising:

a blow-molded body portion having an inwardly set recess; and an elongate, separately-formed, strap handle having a grip portion extending between opposite ends, said handle spanning across said recess and being permanently bonded to said body portion at body portion locations exterior of said recess;

whereby the recess affords placement of fingers around the handle.

2. A blow-molded, plastic container according to claim 1, wherein both of said opposite ends of said handle are permanently bonded to said body portion at locations exterior of said recess by welding techniques.

3. A blow-molded, plastic container according to claim 2, wherein said body portion includes a base, a finish and a sidewall connecting said base to said finish;

wherein said recess is located on said sidewall; and wherein said opposite ends of said handle include an upper tab connected to said grip portion and a lower tab connected to said grip portion remote from said upper tab, said upper tab being attached to said sidewall closer to said finish than said base and said lower tab being attached to said sidewall closer to said base than said finish.

4. A blow-molded plastic container according to claim 3, wherein said sidewall comprises a dome portion below said finish and a lower portion adjacent said base.

5. A blow-molded plastic container according to claim 4, wherein said upper tab of said handle is attached to said dome portion and said lower tab of said handle is attached to said lower portion of said sidewall to thereby span across said recess.

6. A blow-molded plastic container according to claim 4, wherein said recess extends on both said dome portion and said lower portion of said sidewall through a horizontal included angle of about 60°.

7. A blow-molded plastic container according to claim 4, wherein said sidewall has a peripheral label bumper and said recess includes a flex panel extending vertically across said bumper and interrupts it.

8. A blow-molded plastic container according to claim 7, wherein said sidewall has at least one other flex panel disposed on said sidewall.

9. A blow-molded plastic container according to claim 8, wherein said lower portion of said sidewall has a label mounting area.

10. A container having a handle for use in lifting and pouring its contents, comprising:

a blow-molded plastic container body having a base and a finish interconnected by a sidewall, said sidewall having an inwardly set recess; and an elongate separately-formed plastic strap handle having a grip portion between opposite ends, said opposite ends being permanently welded to said sidewall at locations above and below said recess so that said grip portion spans said recess.

11. A container according to claim 10, wherein said opposite ends of said handle include an upper tab and a lower tab, said grip portion being located between said upper and lower tabs, said upper tab having a contact surface for engaging the sidewall above said recess, and said lower tab having a contact surface for engaging the sidewall below said recess.

12. A container according to claim 10, wherein said sidewall comprises a dome portion and a lower sidewall portion and wherein said handle has an upper tab attached to said dome portion and a lower tab attached to said lower sidewall portion with said handle grip portion spanning across said recess.

13. A container according to claim 10, wherein said recess has a vacuum flex panel.

14. A container according to claim 13, wherein said sidewall has at least one other flex panel located exteriorly of said recess.

15. A container according to claim 14, wherein said sidewall has a label mounting area.

16. A container according to claim 10, wherein said container body has at least one horizontally disposed reinforcement rib on said sidewall between said handle and said base.

17. A container according to claim 10, including a plurality of reinforcing ribs extending adjacent at least one of said opposite ends of said handle.

18. A blow-molded, plastic container having a handle affording pouring of its contents, comprising:

a blow-molded body portion having an inwardly set recess; and an elongate, separately-formed, strap handle having a grip portion extending between opposite ends, said handle spanning across said recess and being permanently secured at an end thereof to said body portion;

wherein said recess includes a panel having a peripheral hinge which allows said panel to flex upon cooling of the container when hot-filled and capped;

whereby the recess affords placement of fingers around the handle.

19. A blow-molded, plastic container according to claim 18, wherein said body portion includes a base, a finish and a sidewall connecting said base to said finish; and wherein said recess is formed on said sidewall.

20. A hot-fillable, blow-molded plastic container having a handle affording pouring of its contents, comprising:

a blow-molded body having a base, a finish, and a sidewall connecting said base to said finish;

a flex panel located on said sidewall, said flex panel having a peripheral hinge to allow said flex panel to flex to accommodate volumetric changes of the container contents as they cool after being hot-filled; and an elongate separately-formed strap handle having a grip portion extending between opposite ends, said handle spanning across said flex panel in spaced relation therewith and being permanently secured by welding said body portion at said opposite ends;

whereby the spacing affords placement of fingers around said grip portion of said handle and flexure of said flex panel relative to said handle.

21. A hot-fillable, blow-molded, plastic container according to claim 20, wherein said opposite ends of said handle include an upper tab connected to said grip portion and a lower tab connected to said grip portion below said upper tab.

22. A hot-fillable, blow-molded plastic container according to claim 21, wherein said sidewall comprises a dome portion below said finish and a lower portion below said dome portion, said dome and lower portions being separated horizontally by a peripheral rib.

23. A hot-fillable, blow-molded plastic container according to claim 22, wherein said upper tab of said handle has a laterally oriented attachment surface attached to said dome portion and said lower tab of said handle has a laterally oriented attachment surface attached to said lower portion of said sidewall.

24. A hot-fillable, blow-molded plastic container according to claim 23, wherein said flex panel is recessed inwardly on both said dome portion and said lower portion of said sidewall and interrupts said peripheral rib in the region of said handle.

25. A hot-fillable, blow-molded plastic container according to claim 24, wherein said handle is shaped to conform closely to the vertical contour of the container.

26. A container having a handle for use in lifting and pouring its contents, comprising:

a blow-molded plastic container body having a base and a finish interconnected by a sidewall, said sidewall having an inwardly set recess; and a separate plastic handle having an upper tab, a lower tab, and a grip portion between said upper and lower tabs, said grip portion spanning across said recess in spaced relation, and said upper and lower tabs having been permanently welded to said sidewall;

wherein at least one of said tabs has a welded contact surface extending laterally of the handle for engaging said sidewall.

27. A container having a handle for use in lifting and pouring its contents, comprising:

a blow-molded plastic container body having a base and a finish interconnected by a sidewall, said sidewall having an inwardly set recess; and a separate plastic handle having an upper tab, a lower tab, and a grip portion between said upper and lower tabs, said grip portion spanning across said recess in spaced relation, and said upper and lower tabs having been permanently welded to said sidewall;

including a series of reinforcing ribs disposed in said sidewall laterally of said recess adjacent said lower handle attachment tab.

28. A container having a handle for use in lifting and pouring its contents, comprising:

a blow-molded plastic container body having a base and a finish interconnected by a sidewall; and an elongate separately-formed plastic strap handle having a grip portion between opposite ends, at least one of said opposite ends being permanently attached to said sidewall, said opposite ends including an upper tab and a lower tab, said grip portion being located between said upper and lower tabs, said upper tab having a contact surface for engaging the sidewall, and said lower tab having a contact surface for engaging the sidewall; and wherein said upper and lower tabs of said handle have laterally disposed attachment surfaces permanently welded to said sidewall.

29. A container according to claim 28, wherein said container body defines a vertical axis extending centrally from said base to said finish, and wherein said grip portion extends substantially parallel to said vertical axis.

30. A container according to claim 29, wherein said upper tab extends substantially parallel to said vertical axis.

31. A container according to claim 30, wherein said lower tab extends from said grip portion at an angle relative to said upper tab.

32. A container according to claim 31, wherein said angle is about 6° relative to said vertical axis.

33. A container having a handle for use in lifting and pouring its contents, comprising:

a blow-molded plastic container body having a base and a finish interconnected by a sidewall; and an elongate separately-formed plastic strap handle having a grip portion between opposite ends, and at least one of said opposite ends being permanently attached to said sidewall;

wherein said sidewall has an inwardly set recess, a dome portion, and a lower sidewall portion;

wherein said handle has an upper tab attached to said dome portion and a lower tab attached to said lower sidewall portion with said handle grip portion spanning across said recess; and wherein said recess is located alongside said grip portion of said handle and extends on both said dome portion and said lower sidewall portion.

34. A container according to claim 33, wherein said recess extends through a horizontal included angle of about 60° in said dome portion and said lower sidewall portion.

35. A container having a handle for use in lifting and pouring its contents, comprising:

a hot-fillable, blow-molded plastic container body having a base, a lower sidewall portion connected to said base, a dome sidewall portion connected to said lower sidewall portion opposite said base, a finish extending from said dome sidewall portion, and an inwardly set recess in said dome sidewall portion and said lower sidewall portion; and an elongate separately formed plastic strap handle having an upper tab and a lower tab, and a grip portion connected between said upper and lower tabs, said grip portion spanning across said recess in spaced relation, said upper tab having a contact surface welded to said container body on said dome sidewall portion, and said lower tab having a contact surface welded to said container body on said lower sidewall portion.

* * * * *